US009981196B2

(12) United States Patent
Kurth et al.

(10) Patent No.: US 9,981,196 B2
(45) Date of Patent: May 29, 2018

(54) SPIN ART APPARATUS

(71) Applicant: Kurth Enterprises LLC, East Helena, MT (US)

(72) Inventors: Kimberly Kurth, East Helena, MT (US); David Yakos, Bozeman, MT (US); Kirk Turner, Bozeman, MT (US)

( * ) Notice: Subject to any disclaimer, the term of this patent is extended or adjusted under 35 U.S.C. 154(b) by 0 days. days.

(21) Appl. No.: 15/262,235

(22) Filed: Sep. 12, 2016

(65) Prior Publication Data

US 2018/0071652 A1 Mar. 15, 2018

(51) Int. Cl.
*A63H 13/15* (2006.01)
*A63H 33/22* (2006.01)

(52) U.S. Cl.
CPC ..... *A63H 33/22* (2013.01)

(58) Field of Classification Search
CPC ..... A63H 37/00; A63H 1/22; G09B 11/00; G09B 11/10; B05B 13/0452; B05B 13/0442; B05B 13/0228; B05C 11/08; G03G 15/0839; B01F 13/1058
See application file for complete search history.

(56) References Cited

U.S. PATENT DOCUMENTS 4,030,513 A 6/1977 McKenzie
4,901,846 A * 2/1990 Lehman ..... B44D 3/04 206/1.8
5,242,496 A 9/1993 Handy
5,664,947 A * 9/1997 Dietterich ..... G09B 11/10 434/84
5,672,057 A 9/1997 Engel
5,918,813 A 7/1999 Rucker
6,491,755 B1 * 12/2002 Meinke ..... B05B 13/0228 118/320
7,556,691 B2 7/2009 Rogers et al.
8,564,778 B1 * 10/2013 Igarashi ..... A45D 44/005 356/402
8,763,554 B2 7/2014 Porter
8,958,163 B2 2/2015 MacFadyen et al.
9,180,478 B2 11/2015 Porter
2001/0047951 A1 * 12/2001 O'Connor ..... A45D 34/04 206/575
2003/0165798 A1 * 9/2003 Gilli ..... B44D 2/00 434/84
2006/0207499 A1 9/2006 Rogers et al.
2006/0261184 A1 * 11/2006 Amron ..... B05B 3/02 239/263
2007/0068963 A1 * 3/2007 Amron ..... B05B 3/0427 222/1

(Continued)

*Primary Examiner* — John E Simms, Jr.
*Assistant Examiner* — Urszula M Cegielnik
(74) *Attorney, Agent, or Firm* — Antoinette M. Tease

(57) ABSTRACT

An apparatus for creating spin art comprised of a base assembly, spinning platform and upper assembly. The base assembly includes a central housing, and the upper assembly includes a circular paint wall surrounding a paint container column. The paint container column is positioned in the center of the spinning platform and made up of individual paint container modules that are configured to be stacked vertically on top of one another. The invention also includes a gear drive assembly that is driven by either a manually activated plunger or an electric motor.

12 Claims, 13 Drawing Sheets

(56) References Cited

U.S. PATENT DOCUMENTS

| | | | | |
|---|---|---|---|---|
| 2008/0026347 | A1* | 1/2008 | Whitman | G09B 11/10 434/84 |
| 2009/0003911 | A1* | 1/2009 | Bender | G03G 15/00 399/405 |
| 2009/0078801 | A1* | 3/2009 | Takahashi | B05B 5/0407 239/700 |
| 2010/0285430 | A1 | 11/2010 | MacFadyen et al. | |
| 2011/0195382 | A1* | 8/2011 | Rudell | G09B 11/10 434/84 |
| 2012/0024981 | A1 | 2/2012 | Porter | |
| 2012/0058269 | A1* | 3/2012 | MacFadyen | D06P 1/0016 427/240 |
| 2012/0180722 | A1* | 7/2012 | Nolte | B05B 3/1035 118/712 |
| 2012/0234933 | A1* | 9/2012 | Duprat | B05B 1/16 239/1 |
| 2014/0158713 | A1* | 6/2014 | King | B01F 5/0496 222/143 |
| 2014/0261167 | A1 | 9/2014 | Porter | |
| 2015/0093960 | A1* | 4/2015 | Payne | A63H 17/44 446/424 |
| 2015/0102059 | A1* | 4/2015 | Santrach | B01F 9/0014 222/105 |

* cited by examiner

SPIN ART APPARATUS

BACKGROUND OF THE INVENTION

1. Field of the Invention

The present invention relates generally to the field of toys, and more particularly, to a spin art apparatus for creating paint designs on paper.

2. Description of the Related Art

Various types of "spin art" toys exist; however, these toys are limited in terms of the way the paint is disseminated. For example, most conventional spin art toys rely on gravity to dispense the paint onto a piece of paper that is spinning on a palette. The present invention offers variability in terms of vertically stacked paint containers modules that are both removable and interchangeable. The invention also accommodates paint dispensing accessories that create different paint "impressions." Finally, contrary to prior art, the present invention spins the paint container modules while the paper on which the painting is created remains stationary. As will be made clear in the ensuing discussion, the present invention has additional advantage in terms of cleaning the paint container modules.

Although not a spin toy, U.S. Pat. No. 4,030,513 (McKenzie, 1977) describes a tank washer for washing bulk milk tanks in which a liquid-driven spray head extends downwardly into the tank and rotates, thereby causing washing liquid to be disperses in a centrifugal manner onto the inside walls of the tank. This particular invention does not include individual, vertically stacked containers into which a liquid is dispensed, nor does it include the particular paint container module configuration or the paint dispensing accessories of the present invention.

U.S. Pat. No. 5,242,496 (Handy, 1993) provides a spinning platen paint set and is one illustration of a conventional "spin art" toy. With this invention, a spinning platen (or plate) is covered by a curved shroud with an opening in the center to allow access to the spinning plate. The support housing contains both the spinning platen and a paint mixing stand. The paint mixing stand includes a mixing bottle and a plurality of bottle brush units. Paint is mixed in the mixing bottle and then manually dispensed (by squeezing the mixing bottle) through the opening in the shroud and onto a piece of paper that is affixed to the spinning platen.

U.S. Pat. No. 5,672,057 (Engel, 1997) is another example of a conventional spin art toy. As with the previous invention, this toy includes a spinning platen onto which a piece of paper (or other paint receiving surface) is secured. In this case, the spinning platen is driven by an electric motor and enclosed within a splash container. Both the platen and the splash container are inflatable. To create a painting, the user simply pours or drips paint onto the paint receiving surface.

U.S. Pat. No. 5,918,813 (Rucker, 1999) discloses a rotating spray head in which a pair of offset side nozzles are situated on a generally cylindrical body. The body is attached to a hollow inlet stem to define a generally cylindrical reservoir between them. Liquid flows into the inlet stem and into the reservoir and is dispersed outwardly via the offset side nozzles as the body rotates. This invention stands for the proposition that liquid can be dispensed centrifugally by a rotating body, but it does not include any of the other structural features of the present invention.

U.S. Pat. No. 7,556,691 (Rogers et al., 2009) is yet another example of a conventional spin art toy in which paint is manually dispensed via a funnel into a tubular assembly that terminates in a horizontally oriented hollow tube (referred to as a "transverse section") with open ends on either side of the tube. In an alternate embodiment, the transverse section has multiple open ends. The tubular assembly rotates, and the paint drips (by gravity and centrifugal force) out of the open ends of the horizontal tube onto a piece of paper or other paint receiving surface that is situated directly underneath the tubular assembly.

U.S. Pat. No. 8,956,163 (MacFadyen et al., 2015) is a more recent example of a spin art toy, but the invention is similar to prior art in that the user dispenses paint manually from above a paint receiving surface that is caused to spin by a motor. In this case, a spinning platform (referred to as a "material holding device") situated on top of a motor housing supports the material upon which the painting is to be created. A lid assembly is hingedly attached to a top surface of the motor housing, and a vertical portion of the lid assembly surrounds the spinning platform when the lid assembly is in a closed position. In one embodiment, the spinning platform includes a circular plate-like platform (referred to as a "plunger plate") with a plurality of finger-shaped spiral elements and a disc-like platform (referred to as a "saucer") that rotate together.

U.S. Pat. No. 8,763,554 (Porter, 2014) and U.S. Pat. No. 9,180,478 (Porter, 2015) are related patents that cover a method and apparatus for spray painting soil of a golf hole. In various embodiments, the invention incorporates either a single nozzle or multiple nozzles, and each nozzle may have multiple exit points. The nozzles may also incorporates flat or curved plates for directing the spray paint. The device utilizes masking apparatuses to create desired paint patterns. There is no structural similarity between these two inventions and the present invention other than the fact that paint is dispersed via multiple exit points.

BRIEF SUMMARY OF THE INVENTION

The present in invention is an apparatus for creating spin art comprising: a base assembly comprising a central housing; a spinning platform; an upper assembly comprising a circular paint wall surrounding a paint container column, the paint container column being positioned in the center of the spinning platform and comprising a plurality of individual paint container modules that are configured to be stacked vertically on top of one another; and a gear drive assembly that is configured to be driven by a manually activated plunger. In an alternate embodiment, the present invention is an apparatus for creating spin art comprising: a base assembly comprising a central housing; a spinning platform; an upper assembly comprising a circular paint wall surrounding a paint container column, the paint container column being positioned in the center of the spinning platform and comprising a plurality of individual paint container modules that are configured to be stacked vertically on top of one another; and a gear drive assembly that is configured to be driven by an electric motor.

In a preferred embodiment, the spinning platform has a top surface comprising a central channel that forms a spacer on an underside of the spinning platform, the central channel and spacer both being circular in shape; an inside wall of the central channel is threaded, and a bottom end of a lower-most paint container module screws into the central channel; and an outer wall of the central channel is sufficiently wide to accommodate both the lower-most paint container module and the opposing accessory ports on either side of the lower-most paint container module. Preferably, a bottom end of the circular paint wall is configured to fit inside of the central housing and rest upon a base plate in the central housing, and the spinning platform lies above the base plate of the central housing with only the spacer between the spinning platform and the base plate. The paint container column has a height, and the height of the paint container column terminates beneath a top end of the circular paint wall.

In a preferred embodiment, the circular paint wall comprises a plurality of material retaining clips that are situated around a top edge of the circular paint wall. The spinning platform preferably comprises an outer lip around a perimeter of the spinning platform.

In a preferred embodiment, each individual paint container module is threaded at a top and bottom of the container module. Each individual paint container module preferably comprises opposing accessory ports configured to receive paint application accessories. Each individual paint container module comprises an exit port situated directly above one of the two opposing accessory ports.

In a preferred embodiment, each individual paint container module comprises a circular outer wall and an internal floor that is comprised of three separate flat surfaces, two of which are angled downward to form a central valley and one of which is at a ninety-degree angle to the circular outer wall. Optionally, each individual paint container module further comprises an exit port and an internal ridge that is positioned adjacent and parallel to the central valley and proximate to the exit port.

REFERENCE NUMBERS

Figure 1:
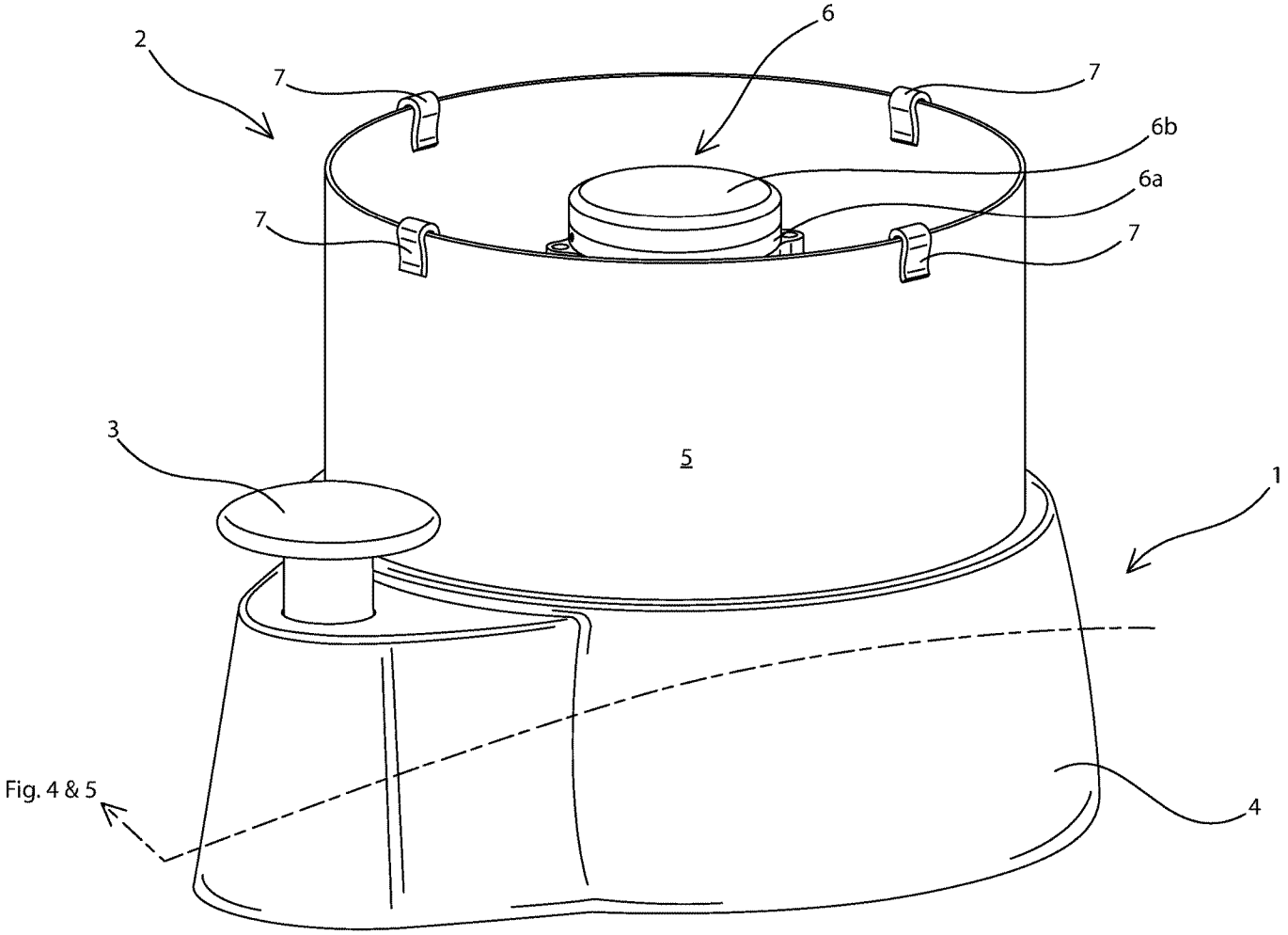
FIG. 1 is a perspective view of the present invention shown fully assembled.

1 Base assembly
2 Upper assembly
3 Plunger
3*a* Plunger body
3*b* Plunger head
4 Central housing
4*a* Base plate (of central housing)
4*b* Central opening (of central housing)
4*c* Housing extension
4*d* Hole (in base plate of central housing)
5 Circular paint wall
6 Paint container column
6*a* Paint container module
6*b* Paint container cap
6*c* Accessory port (of paint container module)
6*d* Exit port
6*e* Circular outer wall (of paint container module)
6*f* Floor (inclined) of paint container module)
6*g* Central line/valley (of paint container module)
6*h* Internal ridge (of paint container module)
6*i* Floor (non-inclined) (of paint container module)
7 Material retaining clip
8 Gear drive assembly
8*a* Ratchet gear
8*b* First full gear
8*b'* Central shaft (of first full gear)
8*c* Second full gear
8*d* Third full gear
8*e* Fourth full gear
8*e'* Slot (in fourth full gear)
8*f* Cylindrical part (of ratchet gear)
8*g* Partial gear (of ratchet gear)
8*h* Ramp (of cylindrical part of ratchet gear)
8*i* Slot (in top part of gear housing)
8*j* Top part (of gear housing)
8*k* Bottom part (of gear housing)
9 Spinning platform
9*a* Outer lip (of spinning platform)
9*b* Key (of spinning platform)
9*c* Spacer (of spinning platform)
9*d* Central channel (in spinning platform)
10 First compression spring
11 Paint application accessory
12 Collar
12*a* Cross-bar (of collar)
12*b* External bracket (of collar)
13 Second compression spring
14 Switch
15 Motor
16 Battery
17 Drive shaft (of motor)
18 Gear drive assembly screw

DETAILED DESCRIPTION OF INVENTION

Figure 2:
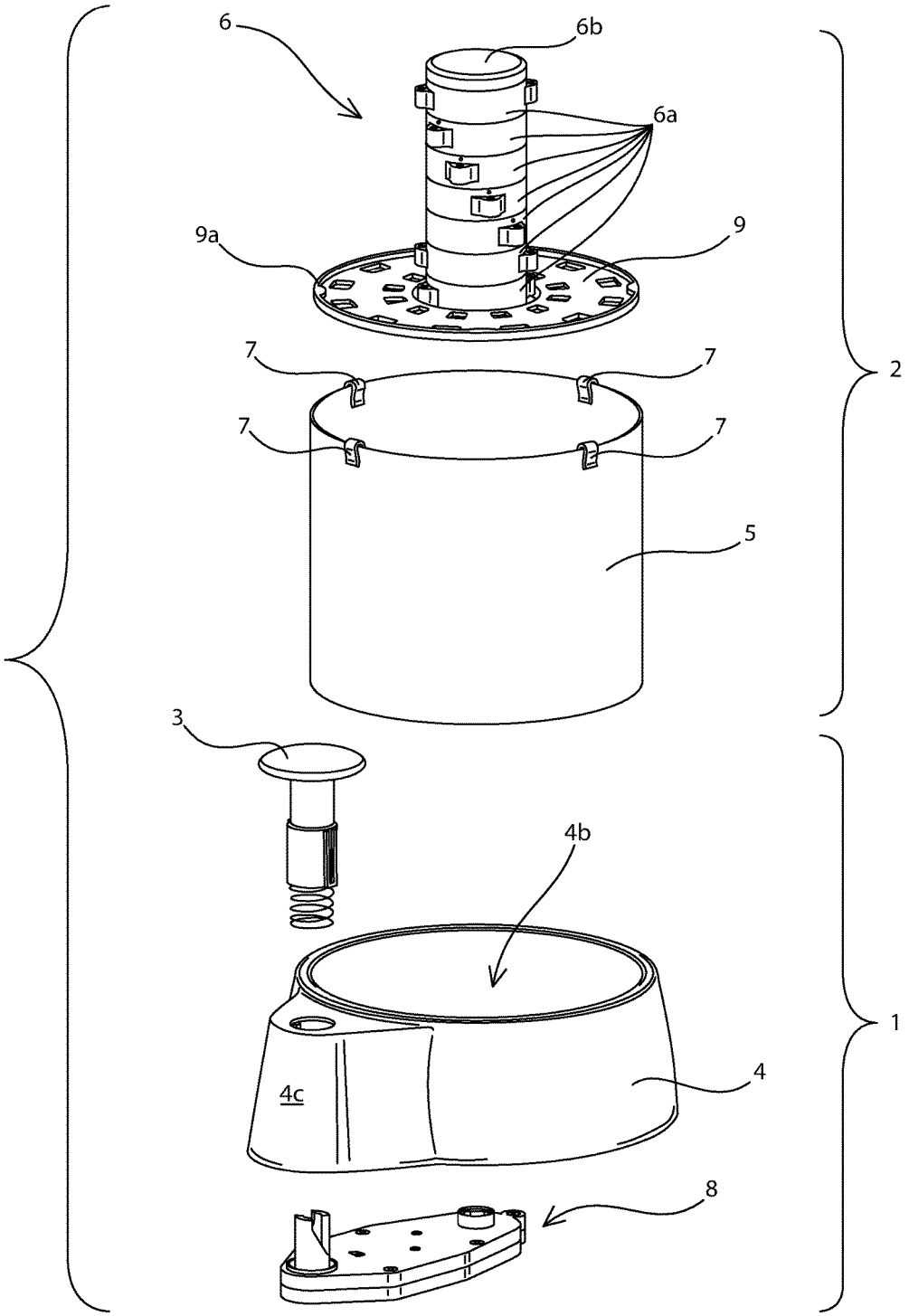
FIG. 2 is an exploded view of the present invention.
Figure 3:
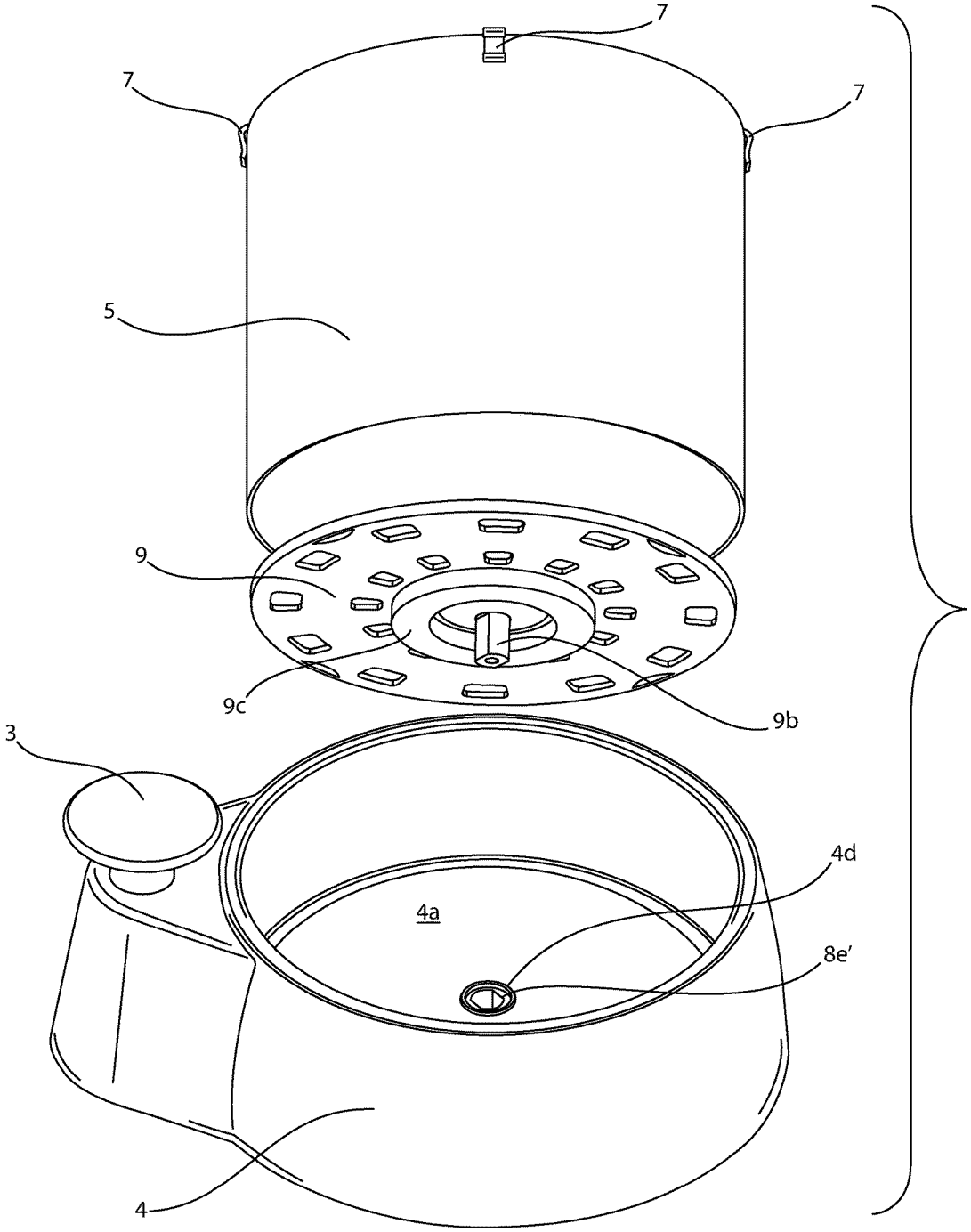
FIG. 3 is a perspective view of the present invention shown with the upper assembly removed from the base assembly.

FIG. 1 is a perspective view of the present invention shown fully assembled. A shown in this figure, the present invention comprises a base assembly 1 and an upper assembly 2. In this particular embodiment (which includes a plunger 3 in lieu of the switch and motor shown in FIG. 16), the base assembly comprises a plunger 3 and a central housing 4. The upper assembly 2 comprises a circular paint wall 5 that surrounds the paint container column 6. As shown more clearly in. FIGS. 2 and 3, the bottom end of the circular paint wall 5 fits inside of the central housing 4 (the outer diameter of the circular paint wall 5 being slightly smaller than the inside diameter of the central housing 4) and rests upon a base plate 4*a* in the central housing 4. The height of the central housing 4 and circular paint wall 5 are such that the top of the paint container column 6 terminates beneath the top end of the circular paint wall 5 (see FIG. 5). Material retaining clips 7 situated around the top edge of the circular paint wall 5 allow the user to affix a piece of paper, cardboard, fabric or other paint receiving surface onto the inside of the circular paint wall 5.

FIG. 2 is an exploded view of the present invention. As shown in this figure, the base assembly 1 comprises the central housing 4, plunger 3 and a gear drive assembly 8. The gear drive assembly 8 is shown in further detail in FIG. 15. The central housing 4 comprises a central opening 4*b* through which the bottom end of the circular paint wall 5 is inserted, a base plate 4*a* (not shown), and a housing extension 4*c* that contains the plunger 3. The paint container column 6 is comprised of a plurality of individual paint container modules 6*a*, which are stacked vertically on top of one another, the entire column being positioned in the center of a spinning platform 9. In a preferred embodiment, the spinning platform 9 comprises an outer lip 9*a* around the outer perimeter of the spinning platform. This lip would allow a piece of paper or other paint receiving material/surface to be positioned on top of the spinning platform 9 so that paint could be dripped or otherwise dispersed onto such receiving material (as with conventional spin art devices); however, the lip 9*a* on the spinning platform 9 is not critical to the present invention. A paint container cap 6*b* is situated on top of the upper-most paint container module.

FIG. 3 is a perspective view of the present invention shown with the upper assembly removed from the base assembly. Note that the paint container column 6 has been removed for clarity. As shown in this figure, the spinning platform 9 comprises a downwardly protruding key 9*b* that fits through a hole 4*d* in the center of the base plate 4*a* of the central housing 4; directly underneath the hole 4*d* is the slot 8*e*' in the fourth full gear 8*e* (see also FIGS. 16A and 16B). The key 9*b* is situated in the center of the spinning platform 9, and the hole 4*d* is situated in the center of the base plate 4*a*. This key 9*b* interacts with the gear drive assembly 8 shown in FIGS. 15, 16A and 16B (and in particular, with the fourth full gear 8*e*). A spacer 9*c* situated underneath the spinning platform 9 eliminates any friction between the spinning platform 9 and the base plate 4*a*. In the embodiment shown, the spacer 9*c* is part of the spinning platform 9 (it is part of the same molded part) and comprised of the same material as the spinning platform. The apertures shown in the spinning platform 9 serve no functional purpose other than to reduce the weight of the platform.

Figure 4:
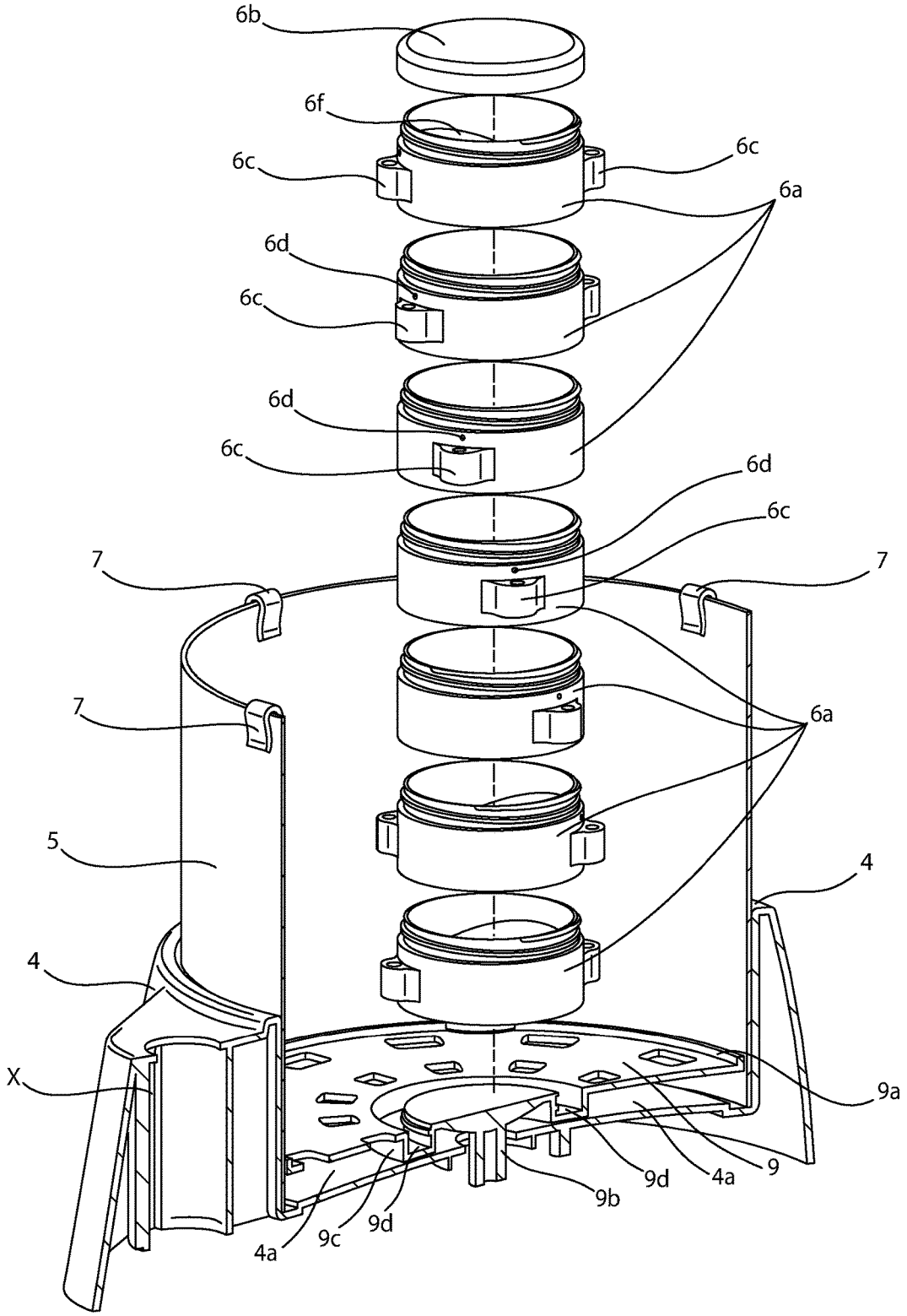
FIG. 4 is a section view of the present invention shown with an exploded view of the paint container column and with the plunger and gear housing removed.

FIG. 4 is a section view of the present invention shown with an exploded view of the paint container column and with the plunger and gear housing removed. As shown in this figure, each individual paint container module 6*a* is threaded at the top and bottom of the container module to enable the individual container modules to be threaded into one another. In this particular embodiment, each container module 6*a* contains outer threads at the top of the container module and inner threads at the bottom of the container module. In a preferred embodiment, each individual paint container module 6*a* comprises opposing accessory ports 6*c* for receiving paint application accessories (see FIG. 11). The paint container cap 6*b* screws onto the top of the upper-most paint container module 6*a* in the paint container column 6. Each paint container module 6*a* preferably comprises an exit port 6*d* situated directly above one of the two accessory ports 6*c*. The exit port 6*d* allows paint to exit the paint container module 6*a* (via centrifugal force) while the paint container module 6 and spinning platform 6 are spinning. When a paint application accessory is inserted into the accessory port 6*c*, it blocks the exit port 6*d* so that the paint contained within the container module 6*a* can leave the container module 6*a* only through the paint application accessory.

As shown in FIG. 4, the top surface of the spinning platform 9 comprises a central channel 9*d* that forms the spacer 9*c* on the underside of the spinning platform 9. The bottom end of the lower-most paint container module 6*a* screws into the central channel 9*d* in the spinning platform 9. Note that both the central channel 9*d* and the spacer 9*c* are circular in shape to conform to the shape of the paint container module 6*a*. The inside wall of the central channel 9*d* is threaded so that the lower-most paint container module 6*a* can screw into the center of the spinning platform 9. When the lower-most paint container module 6*a* is screwed onto the spinning platform 9 and all of the other paint container modules 6*a* are screwed into one another, the entire paint container column 6 spins together with and at the same rate as the spinning platform 9. Note that the individual paint container modules 6*a* are both removable and interchangeable so that the user may use different combinations (and placements) of paint colors. This configuration also allows for easy cleaning of the paint container modules 6*a*.

Figure 5:
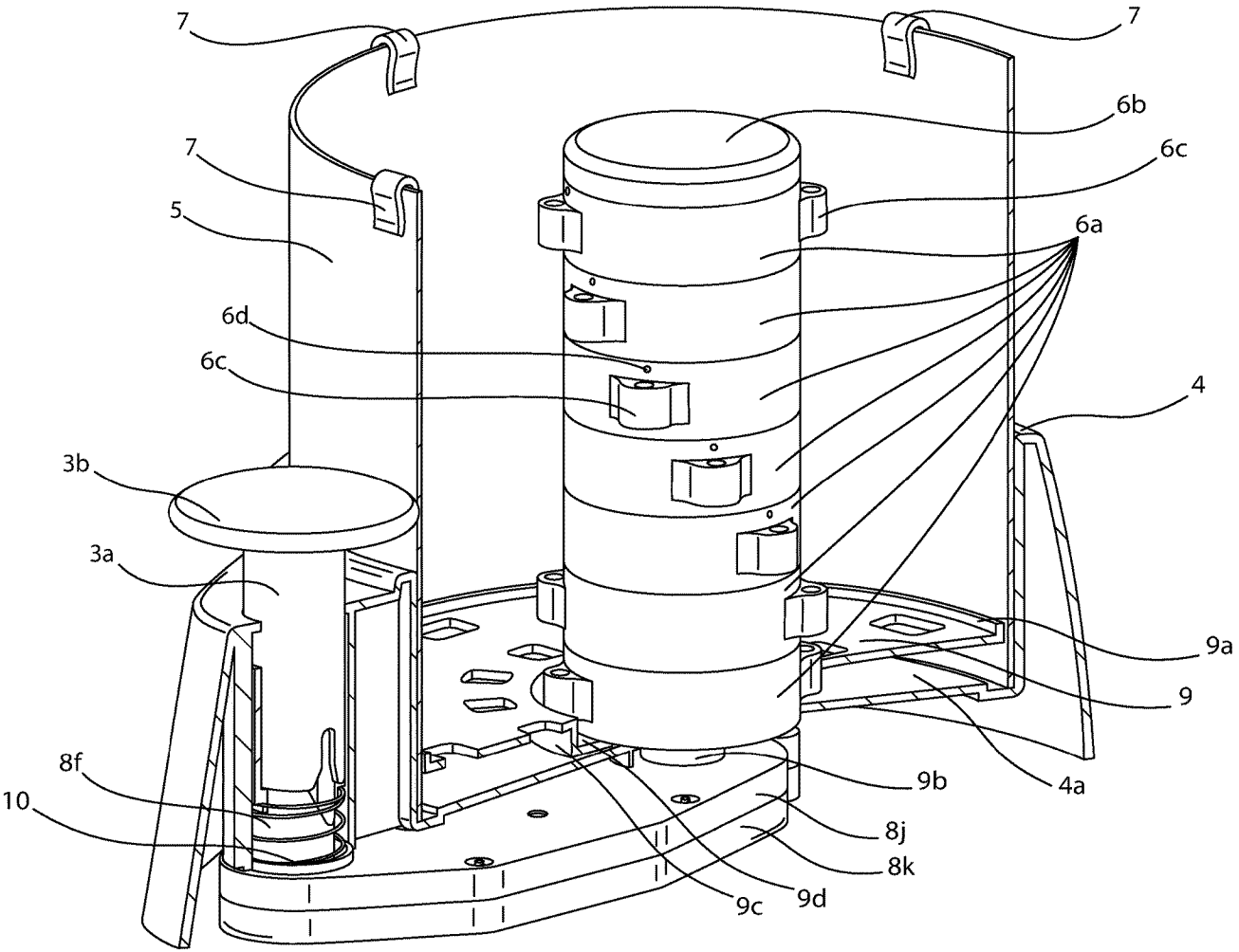
FIG. 5 is a section view of the present invention shown with non-section views of the paint container column and plunger.

FIG. 5 is a section view of the present invention shown with non-section views of the paint container column and plunger. As shown in this figure, in a preferred embodiment, the height of the circular paint wall 5 is such that the top edge of the paint wall 5 extends above the top surface of the paint container cap 6*b*. A compression spring 10 (also shown in FIG. 2) is situated between the bottom end of the plunger and the top surface of the top part 8*j* of the gear housing (see also FIG. 15); the purpose of the compression spring 10 is discussed more fully below in connection with FIG. 15. Note that the central channel 9*d* in the spinning platform 9 is preferably wide enough to accommodate both the paint container module 6*a* and the accessory port 6*c* on either side of the paint container module 6*a*. When the apparatus is fully assembled, the spinning platform 9 lies above the floor of the central housing 4 with only the spacer 9*c* (formed by the central channel 9*d*) between the spinning platform 9 and the housing floor. Note also that the plunger body 3*a* is located mainly within the housing extension 4*c*, and the plunger head 3*b* extends from the top of the plunger body 3*a* and is above (and outside of) the housing extension 4*c*. The plunger 3 is configured such that the plunger head 3*b* can be pressed downward a limited distance (until the plunger head 3*b* abuts up against the top surface of the housing extension 4*c*), thereby compressing the spring 10 and activating the gear system, as discussed more fully in connection with FIG. 15 below.

Figure 6:
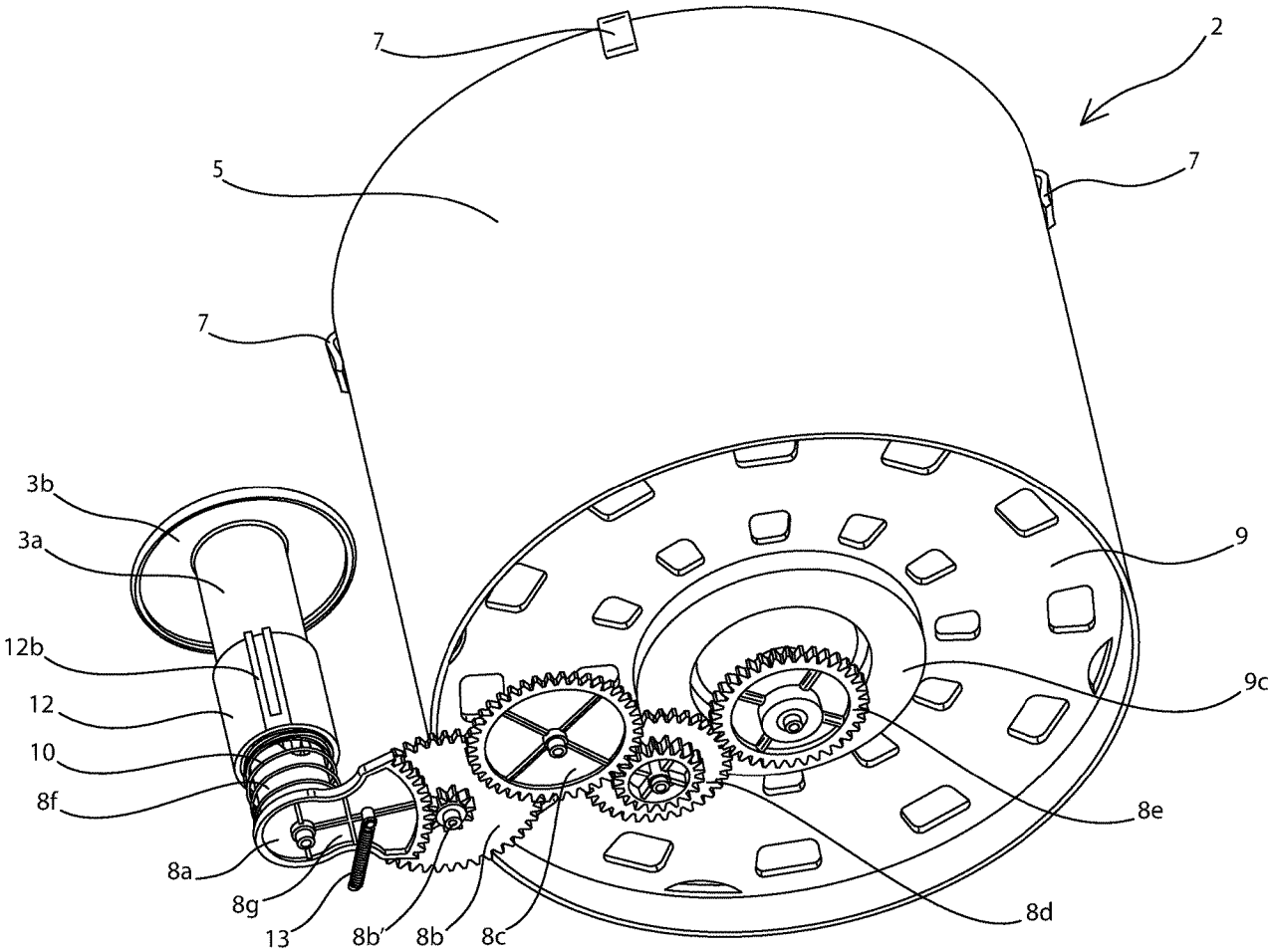
FIG. 6 is a bottom perspective view of the present invention shown with the gear housing removed.

FIG. 6 is a FIG. 6 is a bottom perspective view of the present invention shown with the gear housing removed. This figure shows in detail the gear drive assembly 8, which is discussed more fully below in connection with FIG. 15.

Figure 7:
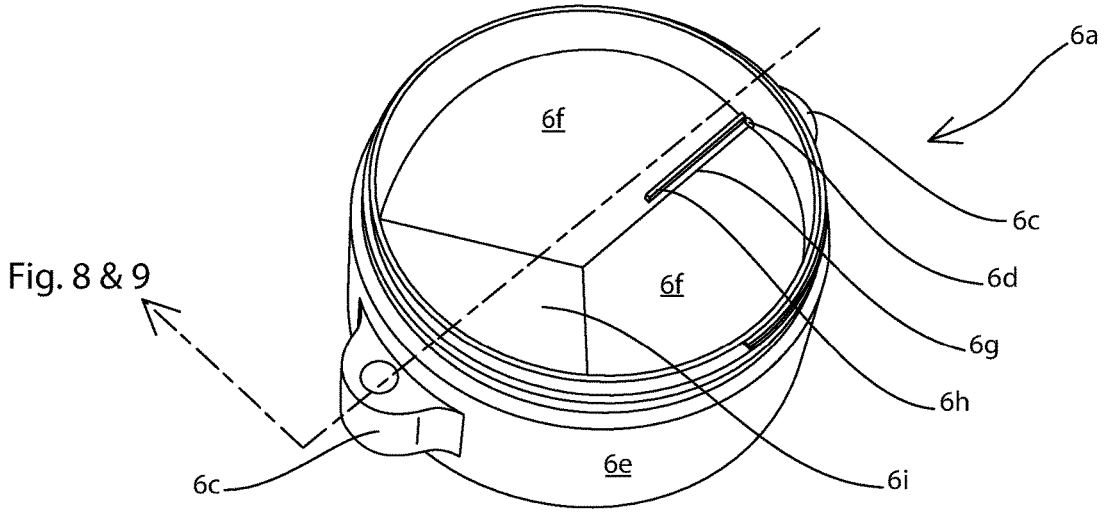
FIG. 7 is a top perspective view of an individual paint container module.
Figure 8:
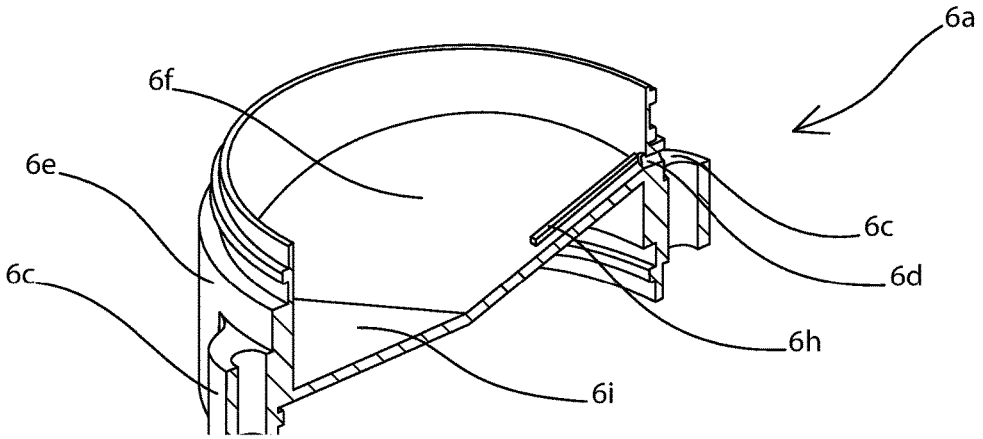
FIG. 8 is a perspective section view of an individual paint container module.
Figure 9:
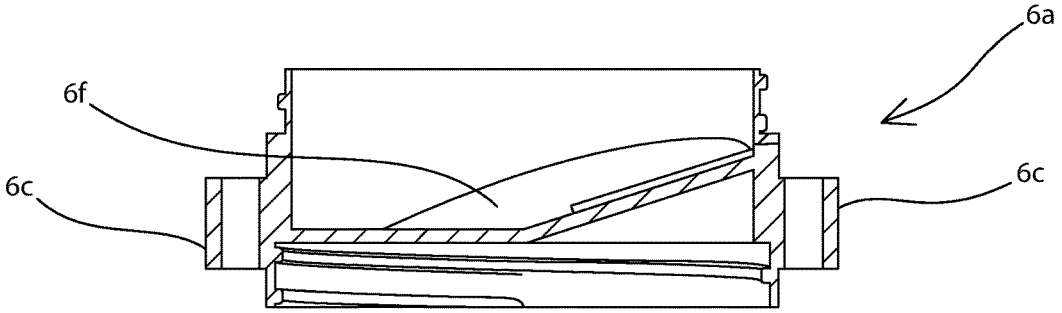
FIG. 9 is a front section view of an individual paint container module.

FIG. 7 is a top perspective view of an individual paint container module. In a preferred embodiment, the paint container module 6*a* comprises a circular outer wall 6*e* and an internal floor that is comprised of three separate flat surfaces (each comprising roughly one-third of the total area of the internal floor), two of which 6*f* are angled downward to form a central line or valley 6*g* that directs the flow of fluid (paint) toward the exit port 6*d* (with centrifugal force forcing it out of the exit port), and one of which 6*i* is at a ninety-degree angle to the circular outer wall 6*e* (see also FIG. 9). This valley configuration prevents paint from accumulating at the periphery of the internal floor when the paint container column 6 is spinning. An internal ridge 6*h* is preferably positioned adjacent and parallel to the central line 6*g* and proximate to the exit port 6*d*. The internal ridge 6*h* is an optional feature designed to assist in directing the paint to flow toward the exit port 6*d*. In a preferred embodiment, each paint container module 6*a* has only one exit port 6*d*. FIGS. 8 and 9 are perspective section and front section views, respectively, of the same paint container module 6*a* shown in FIG. 7.

Figure 10:
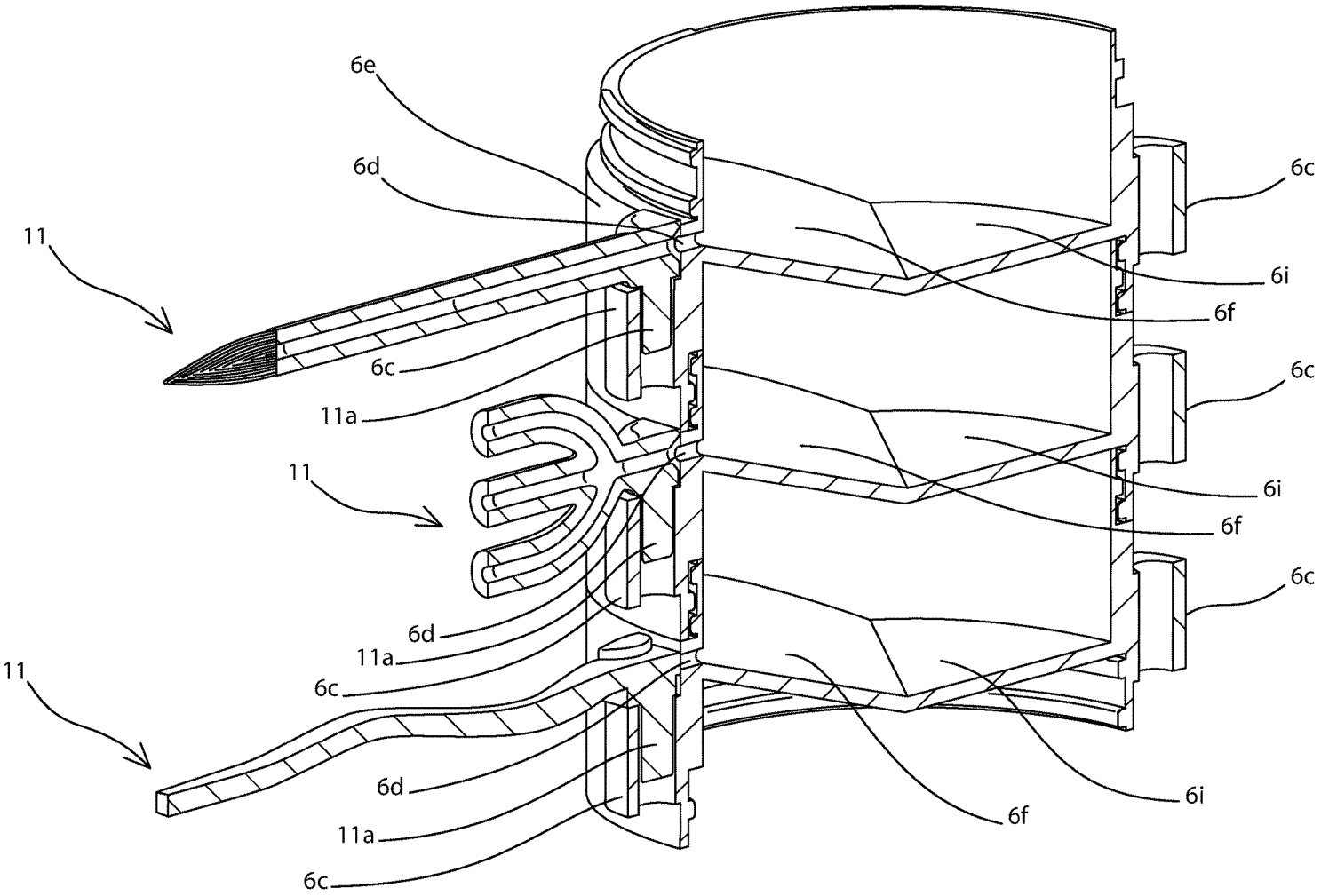
FIG. 10 is a section view of three stacked individual paint container modules shown with three different types of paint application accessories.

FIG. 10 is a section view of three stacked individual paint container modules shown with three different types of paint application accessories. Any number of different paint application accessories may be used with this invention, but this figure shows three different embodiments of the paint application accessories 11. Each of these paint application accessories 11 comprises a downwardly extending member that is inserted into an aperture in the top of the accessory port 6*c*, which secures the paint application accessory 11 into the accessory port 6*c*. In FIG. 10, the top accessory shown is in the form of a writing instrument; note that the instrument is hollow and that the elongated hollow center of the instrument is aligned with the exit port 6*d* so that paint will exit the paint container module 6*a* through the exit port 6*d* and be directed into the instrument, where it will soak the brush-like filaments on the end of the instrument, thereby applying the paint to the paper (or other surface) in a brush-like manner.

The middle accessory shown in FIG. 10 is in the form of a three-pronged candelabra, which is also hollow along its central base and three prongs. The central base of this accessory is aligned with the exit port 63 so that paint exits the paint container module 6*a* and is directed through the central base and out onto the paper via the three prongs of the accessory.

The bottom accessory shown in FIG. 10 is actually a piece of fabric or other flexible material that is held in place both by the downwardly extending member and by a bracket (or lip) on top of the proximal end of the piece of material. The proximal end of the piece of material is aligned with the exit port 6*d* so that paint is directed along the length of the material from the proximal end of the material to the distal end of the material, which is in contact with the paint receiving surface on the inside of the circular paint wall 5.

Figure 11:
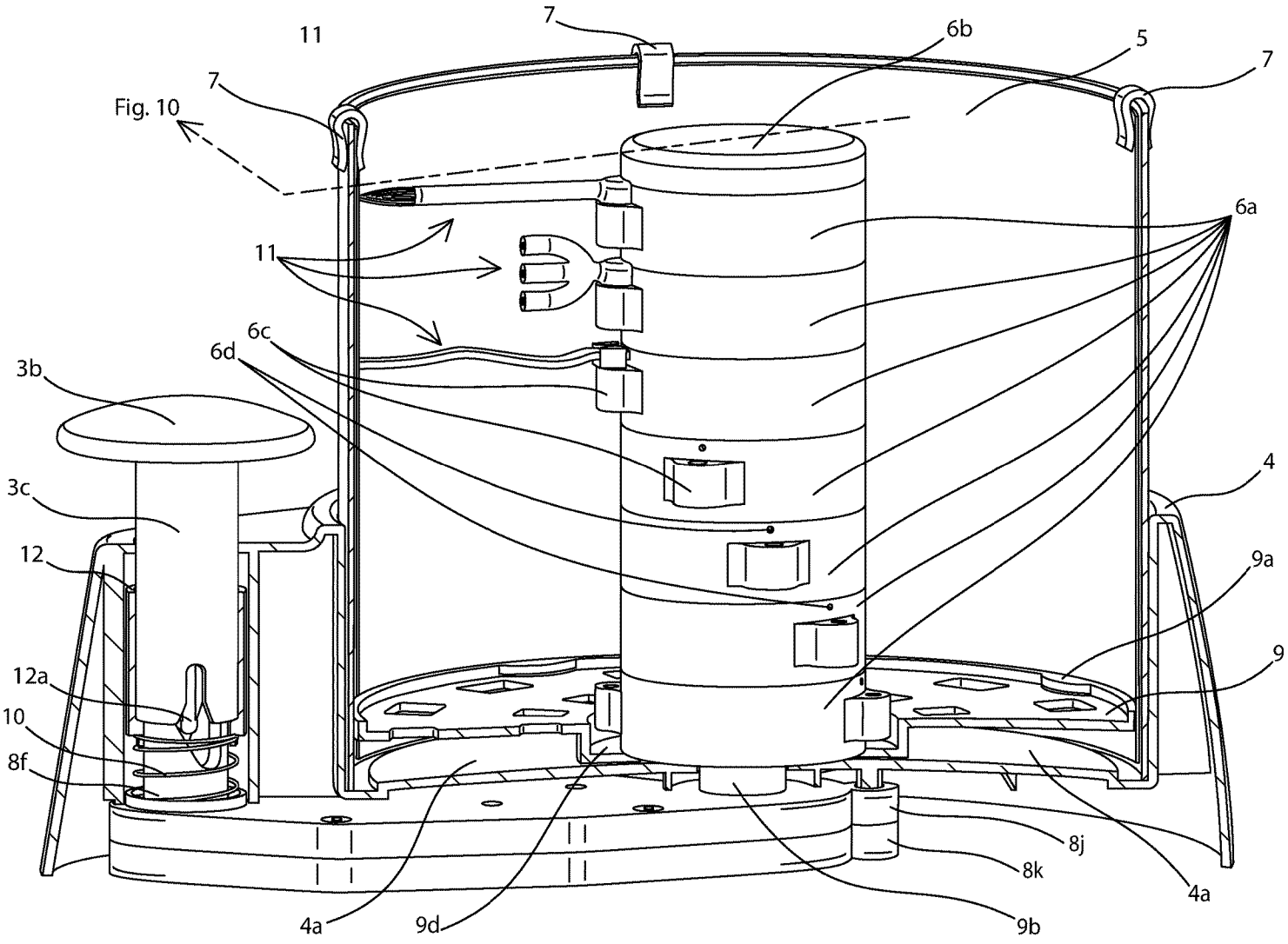
FIG. 11 is a section view of the present invention shown with non-section views of the paint container column, plunger and gear housing and with the paint application accessories of FIG. 10.

FIG. 11 is a section view of the present invention shown with non-section views of the paint container column, plunger and gear housing and with the paint application accessories of FIG. 10. The paint application accessories 11 may be installed in any order, on either or both sides of a paint container module 6*a* and are completely optional. As shown in this figure, the individual paint container modules 6*a* may be positioned so that the accessory ports 6*c* are vertically aligned or staggered.

Figure 12:
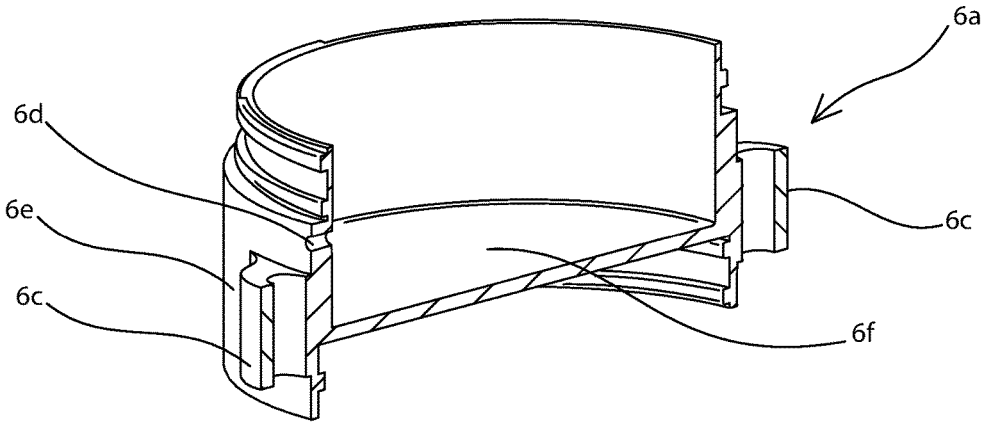
FIG. 12 is a perspective section view of a first alternate embodiment of the individual paint container module.

FIG. 12 is a perspective section view of a first alternate embodiment of the individual paint container module. In this embodiment, the floor of the paint container module 6*a* is completely flat. This embodiment does not have the advantages of the embodiment shown and described in connection with FIGS. 7-9 but may be easier or less expensive to manufacture.

Figure 13:
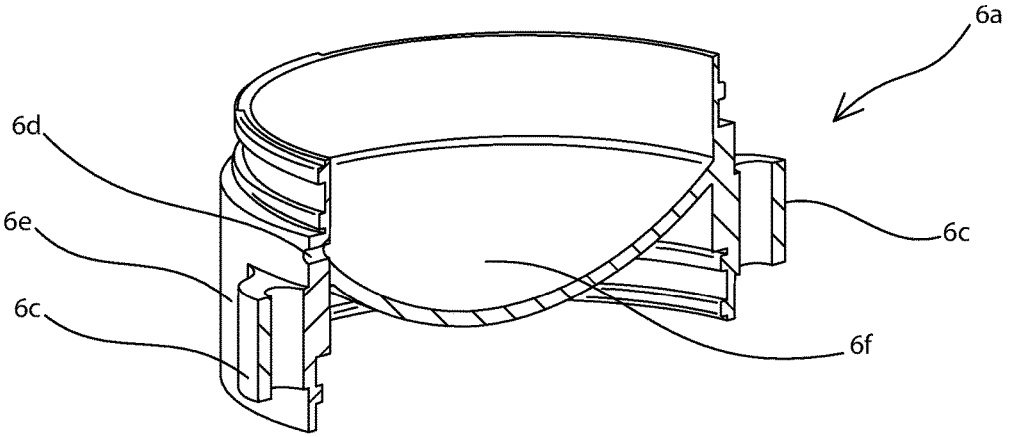
FIG. 13 is a perspective section view of a second alternate embodiment of the individual paint container module.

FIG. 13 is a perspective section view of a second alternate embodiment of the individual paint container module. In this embodiment, the floor of the paint container module 6*a* is saucer-shaped, creating a bowl in the center of the floor. This particular embodiment is advantageous over the embodiment shown in FIG. 12 because the upwardly curved floor facilitates the flow of paint toward the exit port 6*d*.

Figure 14:
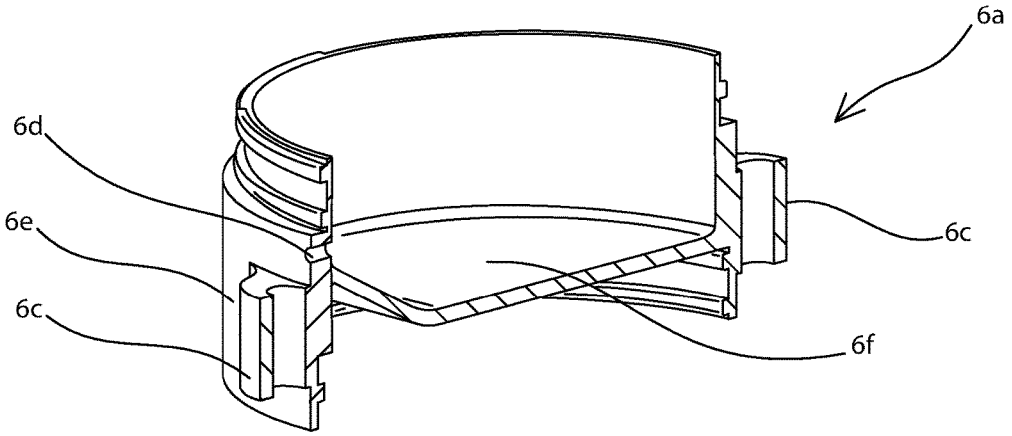
FIG. 14 is a perspective section view of a third alternate embodiment of the individual paint container module.

FIG. 14 is a perspective section view of a third alternate embodiment of the individual paint container module. In this embodiment, the floor is comprised of a level surface and a ramp (or angled wall) that acts to direct the flow of paint toward the exit port 6*d*. The present invention is not limited to any particular configuration, number or shape of paint container modules 6*a* as long as they are stackable to form a paint container column 6 that rotates with the spinning platform 9.

Figure 15:
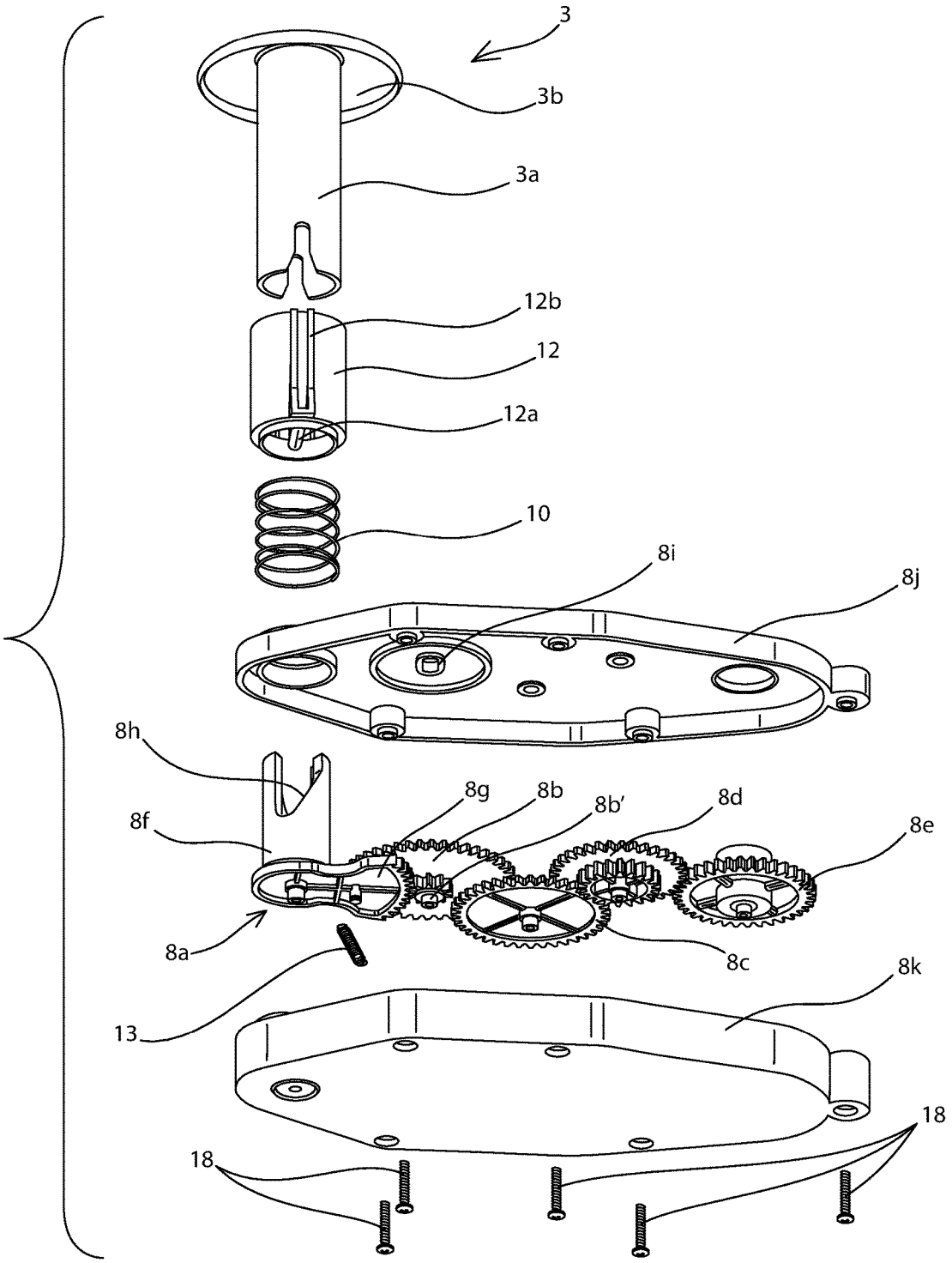
FIG. 15 is an exploded view of the gear drive assembly of the present invention.

FIG. 15 is an exploded view of the gear drive assembly of the present invention. As shown in this figure, the plunger 3 fits inside of a collar 12. The collar 12 comprises a cross-bar 12*a* that extends laterally across the inside of the bottom of the collar 12. The collar 12 further comprises two opposing external brackets 12*b* (only one of which is visible from the perspective shown in FIG. 15) that fit inside of channels or recesses in the central housing 4 (see FIG. 4). In this manner, the plunger 3 and collar 12 are prevented from rotating. The gear drive assembly 8 comprises a ratchet gear 8*a*, a first full gear 8*b*, a second full gear 8*c*, a third full gear 8*d*, and a fourth full gear 8*e*. Note that the ratchet gear 8*a* comprises a cylindrical part 8*f* that extends upward and is open at the top and a partial gear 8*g* that engages with the first full gear 8*b*, as shown. The top end of the cylindrical part 8*f* forms a ramp 8*h*.

When the plunger 3 is depressed, the cross-bar 12*a* travels downward along the ramp 8*h*, thereby causing the partial gear 8*g* of the ratchet gear 8*a* to rotate (the degree of rotation is limited by the length of the ramp 8*h*) and the central shaft 8*b*' of the first full gear 8*b* to move laterally within the slot 8*i* in the top part 8*j* of the gear housing (this occurs by virtue of the interaction between the partial gear 8*g* and the smaller gear located on the bottom of the first full gear 8*b*). At the same time, the first full gear 8*b* begins to rotate and continues rotating until friction causes it to stop rotating. Once pressure is released on the plunger 3, the first compression spring 10 forces the plunger back upward, and the second compression spring 13 (which is connected on one end to the partial gear 8*g* and one the other end to the bottom part 8*k* of the gear housing) pulls the partial gear 8*g* back to the position shown in FIG. 16A.

The gears 8*a*, 8*b*, 8*c*, 8*d* and 8*e* are contained within the bottom part 8*k* of the gear housing. The movement of the central shaft 8*b*' of the first full gear 8*b* within the slot 8*i* causes the first full gear 8*b* to engage and disengage with the second full gear 8*c*, as shown and described more fully below in connection with FIGS. 16A and 16B. As noted above, when the user releases downward pressure on the plunger 3, the spring 10 forces the plunger 3 upward, causing the cross-bar 12*a* to travel upward on the ramp 8*h* and the central shaft 8*b*' of the first full gear 8*b* to move within the slot 8*i* so as to disengage the first full gear 8*b* from the second full gear 8*c*, thereby allowing the second, third and fourth full gears 8*c*, 8*d* and 8*e* to continue rotating (and causing the platform 9 to spin) until they stop rotating due to the forces of friction.

Figure 16A:
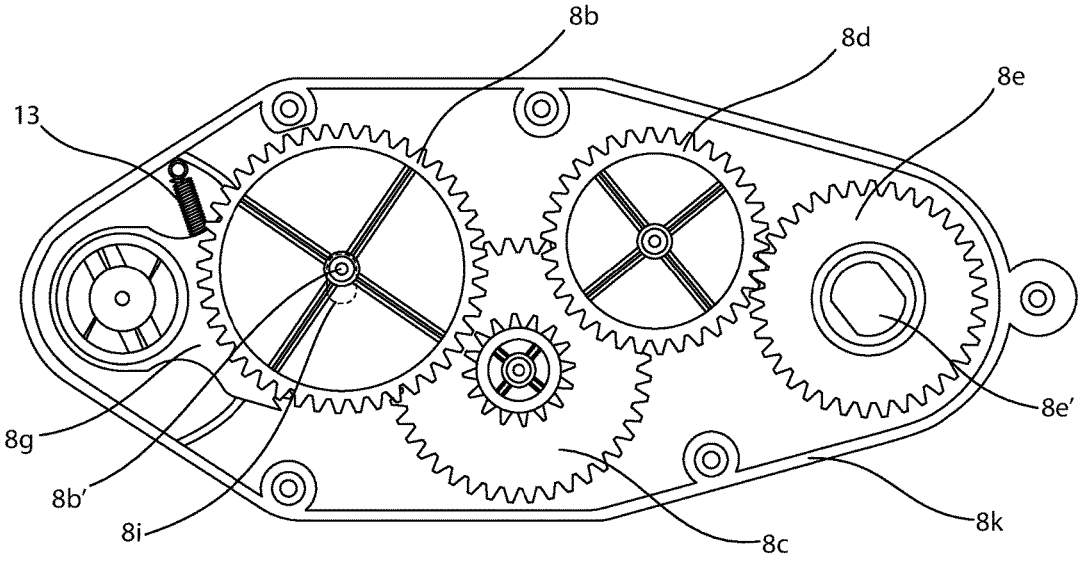
FIG. 16A is a top view of the gear drive assembly shown with the top part of the gear housing removed and with the first full gear in a rest position.
Figure 16B:
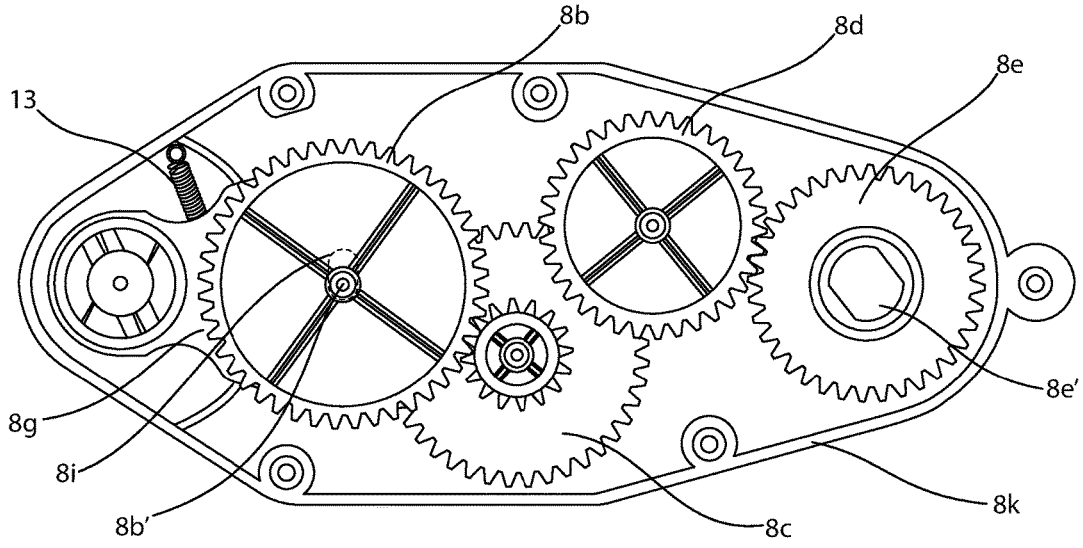
FIG. 16B is a top view of the gear drive assembly shown with the top part of the gear housing removed and with the first full gear engaged with the second full gear.

FIG. 16A is a top view of the gear drive assembly shown with the top part of the gear housing removed and with the first full gear in a rest position. FIG. 16B is a top view of the gear drive assembly shown with the top part of the gear housing removed and with the first full gear engaged with the second full gear. As illustrated in these two figures, when the first full gear 8*b* is in a rest position (i.e., the plunger has not been pressed downward), it is not mechanically engaged with the second full gear 8*c*. When the plunger 3 is pushed downward, however, initiating the actions described above, the first full gear 8*b* engages with the second full gear 8*c*, as shown, thereby causing it to begin rotating. The second full gear 8*c* is mechanically engaged with the third full gear 8*d*, which is mechanically engaged with the fourth full gear 8*e*, thereby causing all three of these gears to rotate together. As noted above, the first full gear 8*b* is only engaged with the second full gear 8*c* for that period of time in which the plunger is depressed; once the first full gear 8*b* disengages from the second full gear 8*c*, the second, third and fourth full gears 8*c*, 8*d*, 8*e* rotate independently of the first full gear 8*b*. Note that the key 9*b* of the spinning platform 9 is configured to fit within the central slot 8*e*' of the fourth full gear 8*e*, thereby causing the spinning platform 9 to spin with the fourth full gear 8*e*.

Figure 17:
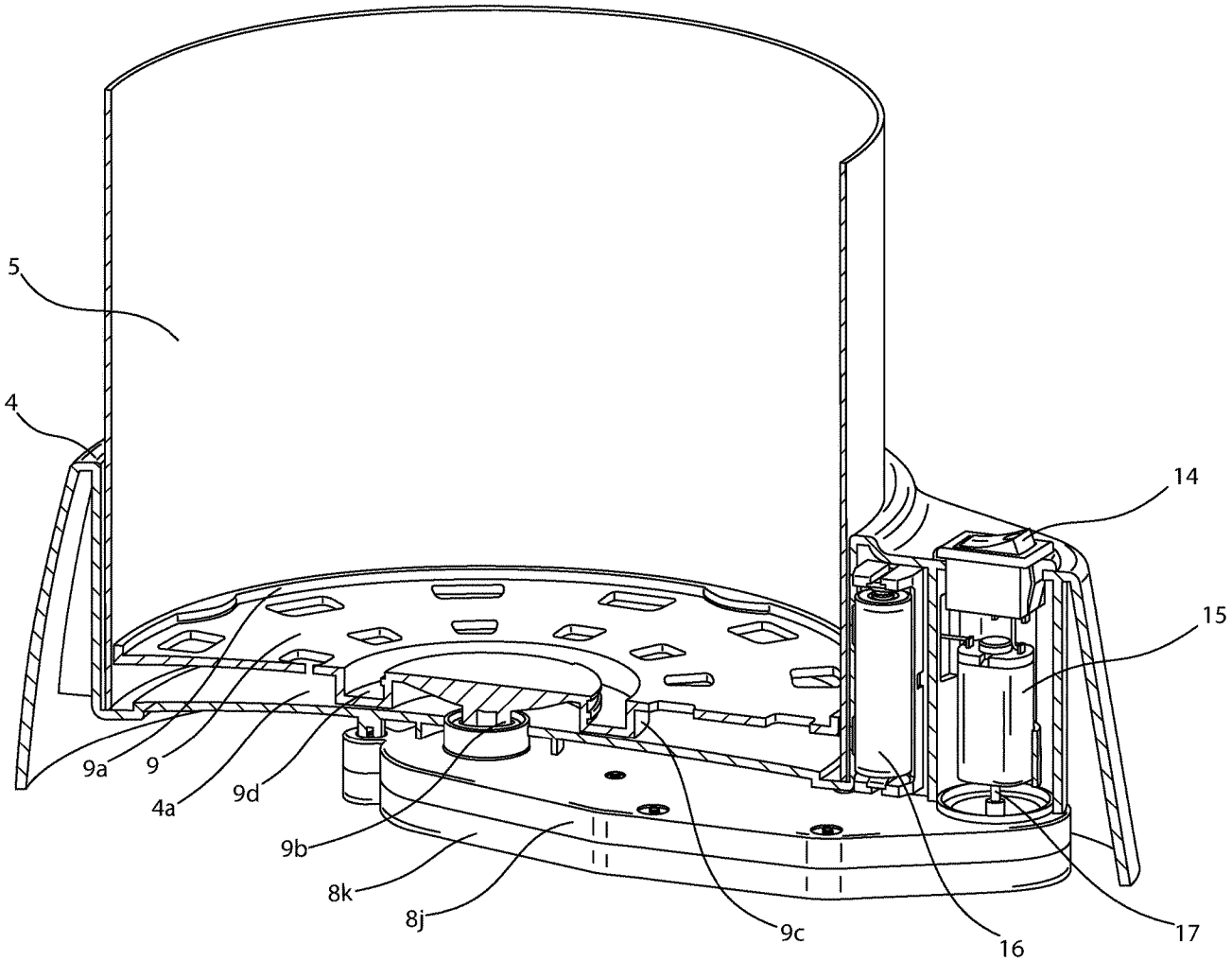
FIG. 17 is a section view of an alternate embodiment of the base assembly in which the plunger is replaced with a switch and motor.

FIG. 17 is a section view of an alternate embodiment of the base assembly in which the plunger is replaced with a switch and motor. The only difference between this embodiment and the manually activated embodiment previously described is that the gear drive assembly 8 is activated by a motor rather than a manually activated plunger 3. This figure shows a switch 14 and electric motor 15 where the plunger 3 was located in the previous embodiment. It also shows the battery 16, which provides power to the motor 15. A drive shaft 17 coupled to and protruding downward from the electric motor would interact with the gear drive assembly 8. The particulars of such interaction are not critical to the present invention.

To use the present invention, a user would place paint into the individual paint container modules 6*a*, screw one paint container module into the spinning platform 9, as previously described, stack the remaining individual paint container modules 6*a* on top of one another (screwing each one onto the next lower module), and screw the paint container cap 6*b* onto the upper-most paint container module. In the manually activated embodiment of the invention, the user would then push the plunger 3 downward, thereby engaging the gears and causing the spinning platform 9 and paint container column 6 to spin, as previously described. This spinning causes the paint in the paint container modules 6*a* to exit each of the modules via the exit ports 6*d* and land on the paint receiving surface that has been clipped to the inside of the circular paint wall 5. In the motorized embodiment of the present invention, the user would activate the motor by flipping the switch (described in connection with FIG. 16).

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. An apparatus for creating spin art comprising:

(a) a base assembly comprising a central housing;

(b) a spinning platform;

(c) an upper assembly comprising a circular paint wall surrounding a paint container column, the paint container column being positioned in the center of the spinning platform and comprising a plurality of individual paint container modules that are configured to be stacked vertically on top of one another; and (d) a gear drive assembly that is configured to be driven by a manually activated plunger;

wherein the gear drive assembly is configured to cause the spinning platform and paint container column to spin when the plunger is pushed downward; and wherein each paint container comprises an exit port that is configured to allow paint to exit the paint container module via centrifugal force while the spinning platform and paint container column are spinning.

2. An apparatus for creating spin art comprising:

(a) a base assembly comprising a central housing;

(b) a spinning platform;

(c) an upper assembly comprising a circular paint wall surrounding a paint container column, the paint container column being positioned in the center of the spinning platform and comprising a plurality of individual paint container modules that are configured to be stacked vertically on top of one another; and (d) a gear drive assembly that is configured to be driven by an electric motor;

wherein the gear drive assembly is configured to cause the spinning platform and paint container column to spin when the motor is activated; and wherein each paint container comprises an exit port that is configured to allow paint to exit the paint container module via centrifugal force while the spinning platform and paint container column are spinning.

3. The apparatus of claim 1 or 2, wherein the spinning platform has a top surface comprising a central channel that forms a spacer on an underside of the spinning platform, the central channel and spacer both being circular in shape;

wherein an inside wall of the central channel is threaded, and a bottom end of a lower-most paint container module screws into the central channel; and wherein an outer wall of the central channel is sufficiently wide to accommodate both the lower-most paint container module and the opposing accessory ports on either side of the lower-most paint container module.

4. The apparatus of claim 3, wherein a bottom end of the circular paint wall is configured to fit inside of the central housing and rest upon a base plate in the central housing, and wherein the spinning platform lies above the base plate of the central housing with only the spacer between the spinning platform and the base plate.

5. The apparatus of claim 1 or 2, wherein the paint container column has a height, and the height of the paint container column terminates beneath a top end of the circular paint wall.

6. The apparatus of claim 1 or 2, wherein the circular paint wall comprises a plurality of material retaining clips that are situated around a top edge of the circular paint wall.

7. The apparatus of claim 1 or 2, wherein the spinning platform comprises an outer lip around a perimeter of the spinning platform.

8. The apparatus of claim 1 or 2, wherein each individual paint container module is threaded at a top and bottom of the container module.

9. The apparatus of claim 1 or 2, wherein each individual paint container module comprises opposing accessory ports configured to receive paint application accessories.

10. The apparatus of claim 9, wherein the exit port of each individual paint container module is situated directly above one of the two opposing accessory ports.

11. The apparatus of claim 1 or 2, wherein each individual paint container module comprises a circular outer wall and an internal floor that is comprised of three separate flat surfaces, two of which are angled downward to form a central valley and one of which is at a ninety-degree angle to the circular outer wall.

12. The apparatus of claim 11, wherein each individual paint container module further comprises an internal ridge that is positioned adjacent and parallel to the central valley and proximate to the exit port.

* * * * *